US006768466B1

(12) United States Patent
Andrieu et al.

(10) Patent No.: US 6,768,466 B1
(45) Date of Patent: Jul. 27, 2004

(54) BROAD-BAND SCISSOR-TYPE ANTENNA

(75) Inventors: Joël Jean-Paul Félix Andrieu, Saint Pantaleon de Larche (FR); Bruno Beillard, Limoges (FR); Yvon Imbs, Brive (FR)

(73) Assignee: Centre National de la Recherche Scientifiques (C.N.R.S.), Paris (FR)

( * ) Notice: Subject to any disclaimer, the term of this patent is extended or adjusted under 35 U.S.C. 154(b) by 0 days.

(21) Appl. No.: 10/130,755

(22) PCT Filed: Oct. 18, 2000

(86) PCT No.: PCT/FR00/02905

§ 371 (c)(1),
(2), (4) Date: Sep. 30, 2002

(87) PCT Pub. No.: WO01/39319

PCT Pub. Date: May 31, 2001

(30) Foreign Application Priority Data

Nov. 26, 1999 (FR) ..... 99 14940

(51) Int. Cl.[7] ..... H01Q 9/44
(52) U.S. Cl. ..... 343/707; 343/735
(58) Field of Search ..... 343/735, 740, 343/809, 707

(56) References Cited

U.S. PATENT DOCUMENTS 2,165,958 A 7/1939 Carter ..... 250/33
3,680,133 A * 7/1972 Tsao et al. ..... 343/719
3,680,148 A 7/1972 Nolan ..... 343/797
3,928,854 A * 12/1975 Tacussel ..... 343/735
5,600,332 A 2/1997 Brown et al. ..... 343/707
5,945,962 A 8/1999 Harrington et al. ..... 343/792.5

FOREIGN PATENT DOCUMENTS

GB 2 151 082 7/1985

OTHER PUBLICATIONS

Y. Imbs et al., "UWB Measurements of Canonical Targets with a New Broad Band Wire Antenna", International Geoscience and Remote Sensing Symposium Proceedings, IGARSS '98. Sensing and Managing the Environment, vol. 2, Jul. 6–10, 1998, pp 770–772.

Y. Chevalier et al., "New Broad Band Resistive Wire Antenna for Ultra–Wide–Band Applications", Ultra–Wide-band Short–Pulse Electromagnetics 4, Jun. 14–19, 1998, pp 157–164.

* cited by examiner

*Primary Examiner*—James Clinger
(74) *Attorney, Agent, or Firm*—Young & Thompson

(57) ABSTRACT

A broad-band antenna includes in a common plane tow symmetrical parts (2,3) each including at least two interconnected conductor strands (4,5,7,8;19,20,21) powered by a double-wire line (10;22), each strand including in its portion opposite the double-wire line, a resistive load (11, 12,14,15;23,24,25,26).

15 Claims, 7 Drawing Sheets

BROAD-BAND SCISSOR-TYPE ANTENNA

BACKGROUND OF THE INVENTION

The present invention concerns broad band antennas and relates more particularly to antennas adapted to ultra-short high voltage pulses.

DESCRIPTION OF THE RELATED ART

All of the broad band antennas at present available on the market are arranged to function in permanent harmonic operation and are used for various applications such as, for example, electromagnetic compatibility tests or measurements of Surface Equivalent Radar or SER. The most widely used are, among others:

horns with baffles

Log-periodic,

Vivaldi antennas, butterfly antennas, spirals, biconical antennas, etc.

In spite of the great diversity of these types of antennas, the majority of them do not offer the features desired for experiments in the transient field.

In order to have a high performance with respect to time, the antennas should be naturally broad band in order to cover the spectrum range of the pulse delivered by an associated pulsed generator. They should in addition have particular qualities, appropriate to the radiation or the measurement of ultra-short pulses. It is in fact important that the antennas have a transfer function with low dispersion in frequency so that the radiated or received pulse is neither deformed nor spread. A significant distortion of the signal results in elongation of the responses with respect to time of the various targets and causes the loss of one of the main interests of the transient methods, that is to say, the possibility of separating the useful echoes from the interference paths by simple time "windowing".

Among the conventional broad band aerials at present available on the market, horns, horns with baffles and Log-periodic are the antennas most commonly used.

In the following there is given, for each of these types of antennas, the electric field radiated in the axis, when the excitation signal applied to the antenna is a Gaussian pulse, having a width at mid-height of 700 ps.

a) The horn proposed by way of example is designed by means of the code of calculation by finite differences in the transient field. The dimensions of the horn are determined so that its passband extends from 100 MHz to 1 GHz. The excitation of the guide is effected by imposing in a sectional plane a spatial distribution of the electric field according to the TEO1 mode ($\sin\pi y/a$) with a: dimension of the guide along the axis y. The pulse radiated in the axis at long range has a time spread of about 80 ns; it is only really significant over 30 ns.

This type of antenna is not therefore adapted to function in transient operation. Each spectrum component is in fact emitted from a phase centre which moves within the horn, thereby in part bringing about the spread of the signal.

Moreover, the size of the antenna at these frequencies becomes very large, hence a not inconsiderable bulk and difficulties of implementation.

b) The horn with baffles has the particular feature of having a large passband (200 MHz–2 GHz) while maintaining relatively modest dimensions. The use of baffles at the exponential profile makes it possible to obtain a high gain over the whole passband. This horn was tested in an anechoic chamber at CELAR. The radiated electric field has a time spread of about 15 ns.

The pulse is in part deformed by the poor performances of the horn at low frequency. Evanescent modes are in fact excited below the cut-off frequency of the guide, thereby disturbing the radiated electric field. The baffles and the reflections at the ends of the plates may also contribute to the dispersion of the signal.

c) The Log-periodic antenna is an assembly of parallel dipoles powered by a transmission line, in such a manner that two consecutive dipoles are of opposite phase.

Each strand radiates with a maximum efficiency when the supply half wave-length is equal to its own length.

Thus, the high frequency of the antenna is limited by the dimension of the smallest strand, and the low frequency by that of the largest strand. The Log-periodic antenna has been designed by means of the code of calculation of integral equations.

The geometrical dimensions were determined so that the antenna should be directional and cover a spectrum of 100 MHz to 1 GHz. This type of antenna mainly emits a horizontal electric field, the duration of which is relatively long.

The successive resonances of the strands constituting the antenna are the origin of the dispersion that can be observed on the radiated signal.

The conventional broad band antennas are not therefore suitable for radiating an ultra-short pulse. Numerous researches have however been carried out for many years in order to design devices capable of radiating high level pulses with a minimum of distortion, but these antennas are not at present available on the market.

SUMMARY OF THE INVENTION

It therefore appeared necessary to design an antenna, simple to implement and not bulky, and above all guaranteeing correct electromagnetic performances for the two modes of operation, transient and harmonic.

The subject of the invention is a broad band antenna, characterised in that it comprises in a common plane two symmetrical parts each including at least two interconnected conductor strands powered by a double-wire line, each strand comprising in its portion opposed to the double-wire line a resistive load.

According to other features of the invention:

each symmetrical part further comprises at least one strand not connected to the other strands and including in its portion opposed to the supply line a resistive load, each symmetrical part comprises n conductor strands, interconnected or not, and each including a resistive load at its end, n being greater than 2.

BRIEF DESCRIPTION OF THE DRAWINGS

The invention will be more easily understood on reading the following description, provided solely by way of example and with reference to the appended drawings, in which.

DESCRIPTION OF THE PREFERRED EMBODIMENTS

Figure 1:
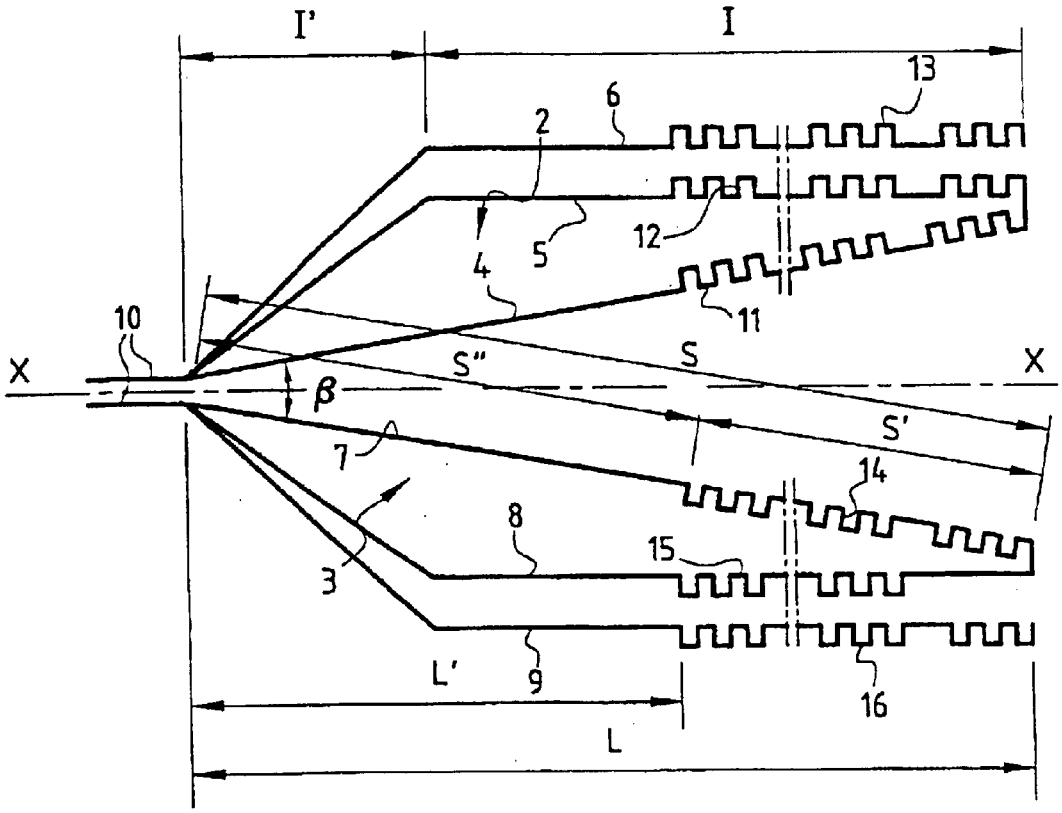
FIG. 1 is a diagrammatic view of a first embodiment of a scissor-type antenna according to the invention.

FIG. 1 shows diagrammatically a broad band scissor-type antenna according to the invention.

The antenna comprises, in a common plane which is the plane of the drawing, two parts 2,3, symmetrical with respect to an axis X—X.

Each symmetrical part 2,3 includes in the present example three conductor strands 4,5,6 and 7,8,9, respectively.

The strands 4,5 and 7,8 are interconnected by their ends.

The strands 6 and 9 are connected by one of their ends to the corresponding connections of the strands 4,5 and 7,8, and their opposite ends are not connected.

The antenna thus constituted is energized directly by a double-wire line 10.

At their interconnected or free ends, the strands 4,5,6,7, 8,9 comprise respective resistive loads 11,12,13,14,15,16 each formed by resistances in series.

Each symmetrical part may of course include a number n of strands other than 3 and greater than or equal to 2, the strands being interconnected or not.

The electric field is then guided inside the line 10, then propagated in space. The polarization of the electric field E is mainly vertical rectilinear and simple rotation of the antenna through 90° makes it possible to obtain horizontal rectilinear polarization.

The whole of the device is contained in a single lane, hence the total absence of crossed polarization.

The electromagnetic qualities of the antenna (input impedance, gain, radiation pattern, passband, dispersivity) depend essentially on the geometric dimensions such as the length and the angle of opening. Intuitive reasoning leads to the thought that the low cut-off frequency is linked to the length while the high cut-off frequency is limited by the opening of the line.

Conventional broad band antennas (TEM horns, horns with baffles, Log-periodic) are not suitable for radiating an ultra-short (1 ns), high level (>10 kV) pulse, with a minimum of distortion (dispersion coefficient: greater than 15 for a horn with baffles, than 30 for a conventional horn, than 120 for a Log-periodic).

The new concept proposed according to the invention is an original aerial with wire strands, simple to implement, which, while covering a broad band of frequencies is capable of radiating an ultra-short high voltage pulse with a dispersion coefficient of less than 1.4.

The length s of the strands 4 to 9 is linked to the lowest frequency contained in the spectrum of the signal to be radiated and should be equal to at least a half-wavelength, or:

$$s \geq \frac{\lambda_{min}}{2}$$

The angle of opening of the antenna is determined as follows.

There are in the literature formulae adapted to the design of an antenna of close geometry and constituted solely by two wires: the V-shaped dipole. These empirical equations make it possible to determine the optimum internal angle of the device for which the gain is maximum on the axis, according to the length s of the strand and to the wavelength λ.

When $$0.5 \leq \frac{s}{\lambda} \leq 1.5: \beta = -149.3\left(\frac{s}{\lambda}\right)^3 + 603.4\left(\frac{s}{\lambda}\right)^2 - 809.5\left(\frac{s}{\lambda}\right) + 443.6$$

When $$1.5 \leq \frac{s}{\lambda} \leq 3.0: \beta = -13.39\left(\frac{s}{\lambda}\right)^2 - 78.27\left(\frac{s}{\lambda}\right) + 169.77$$

For s/λ>3, it is possible to have recourse to extrapolation of the preceding formula.

It has proved useful according to the invention to join to the V-shaped dipole a plurality of additional strands, connected or not connected at their ends, the geometric shapes of which have been optimized by parametering to improve the electromagnetic performances of the device:

- more stable input impedance over the whole of the frequency band,
- improvement of the directivity, (amplitude of the field reinforced on the axis),
- total absence of crossed polarization, the fields are better maintained between the two planar lines.

As shown in FIG. 1, the scissor-type configuration for the first two strands proved to be the best. The outer strands 5,6 and 8,9 of each symmetrical part are each formed of divergent sections 5*a*,6*a*,8*a*,9*a* extended by sections 5*b*,6*b*, 8*b*,9*b* parallel to one another. The parallel sections have a length 1, while the divergent sections have a projection in the direction of the parallel sections of length l'. The lengths l and l' selected as indicated below guarantee the best performances:

$$l=2L/3 \text{ and } l'=L/3$$

where L is the total length of the antenna.

The input impedance depends on the geometry of the aerial and of the adaptation resistive loads, but also on the diameter of the wire strands 4 to 9. A small radius of the strands reinforces the inductive effects of the wires, hence an increase in the imaginary part with the frequency.

On the other hand, a large radius (r=1 cm) makes it possible to maintain a low imaginary part over the whole of the band. To facilitate the adaptation of the device, it is therefore of paramount importance to select a minimum radius of 1 cm.

The problem of adaptation of the ends is solved as follows.

A conventional antenna has at its ends an open circuit which is the origin of reflections which have an adverse effect on the performances of the antenna. These resonances are responsible for consequent elongation of the transient signals radiated, but also for degradation of the standing wave rate at the input of the antenna.

This problem is solved by distributing resistive loads 11 to 16 over the length of the ends of the different strands 4 to 9. The currents carried on each conductor are progressively attenuated to virtually cancel each other out and thus reduce the interference emissions and reflections.

For example, the following law of evolution of resistances Z(p) obeying the principle of non-reflection of Wu and King, is perfectly suitable:

$$Z(\rho) = \frac{Z_0}{1 - \frac{\rho}{s'}} \text{ avec } 0 \leq \rho < s'$$

where s': portion of line with resistive load, p position of the resistive element on the strand, $Z_0$: first load at p=0 m.

The value $Z_0$ should be selected to be between 10Ω and 30Ω, and a resistance positioned about every 5 cm. The values to be set are not critical, hence the possibility of having recourse to another contiguous hyperbolic law.

Thus, embodiments simple to implement have been produced by associating a plurality of resistances of standard values in parallel along each end.

It is also possible to use tapes of variable resistivity.

The main drawback of this technique is that the overall output of the antenna is lowered. Therefore, in order to avoid impairing the gain too much, only the upper parts of each strand are provided with resistive loads.

The length of the strands and the portion of line provided with a resistive load are generally linked by the relation: s/3<s'<s/2.

The determination of the high cut-off frequency ($f_{max}$) is effected as follows.

A parametric study showed the existence of a frequency at which the gain in the axis is at a minimum. A destructive interference appears if the difference in path length between the length L' of the antenna devoid of resistive loads and the length S" of the strands participating in the radiation, corresponds to λ/2 for the spectrum component under consideration. This phenomenon may be expressed by:

$$s''L' << \lambda/2$$

therefore f<<c/2(s"−L')

c being the speed of light.

In general, $f_{max}$ is taken as =c/6(s"−L')

The radiation diagrams of the scissor-type antenna according to the invention result from a combination between the inherent radiation of each of the strands.

In the final result, the main lobe is a maximum on the axis, but it is accompanied, in elevation, by minor lobes the level of which is lower in the majority of cases. The level of the minor lobes is generally below 8 dB with respect to the main lobe.

The use of resistive loads 11 to 16 makes it possible to limit in particular the radiation rearward of the line (lower by more than 15 dB than the radiation in the axis), thereby improving the directivity of the patterns.

The results will be given below for an example of a scissor-type antenna (n=2) (200 MHz–1.6 GHz) of the type shown in FIG. 2.

Figure 2:
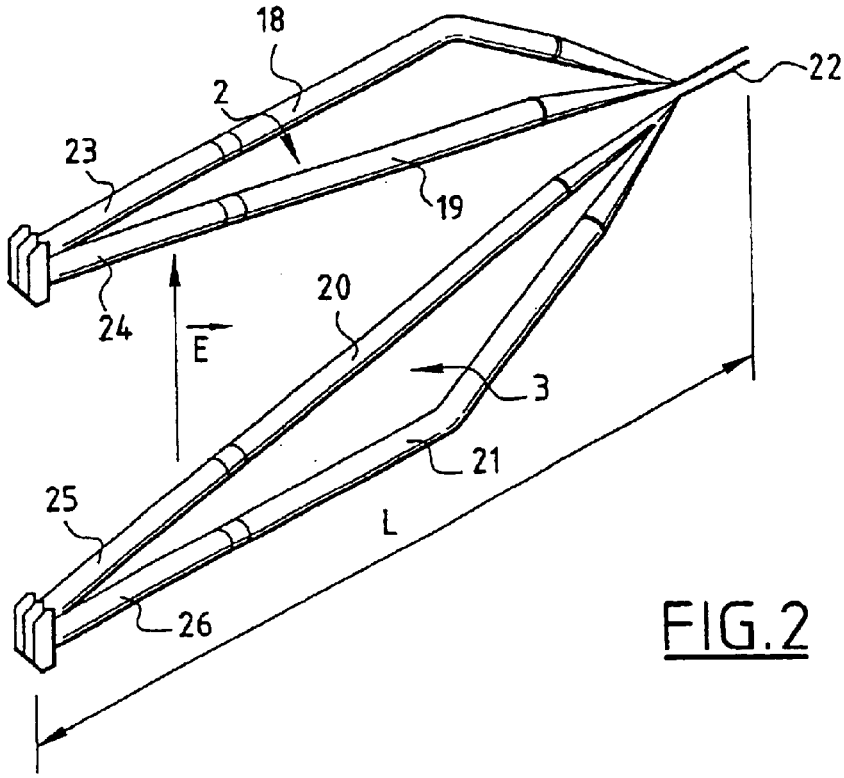
FIG. 2 is a perspective view of a second embodiment of a scissor-type antenna according to the invention.

The antenna shown in FIG. 2 comprises in each symmetrical part 2,3, two strands 18,19,20,21 connected by their ends opposed to an energizing line 22.

The geometric dimensions of the antenna in FIG. 2 (n=2), established on the basis of the preceding design rules, are:

L=1 m

L'=0.7 m s=1.044 m s'=0.3 m s"=0.744 m l=0.65 m l'=0.35 m r=0.01 m

Each strand includes a corresponding resistive load 23,24.

Figure 3:
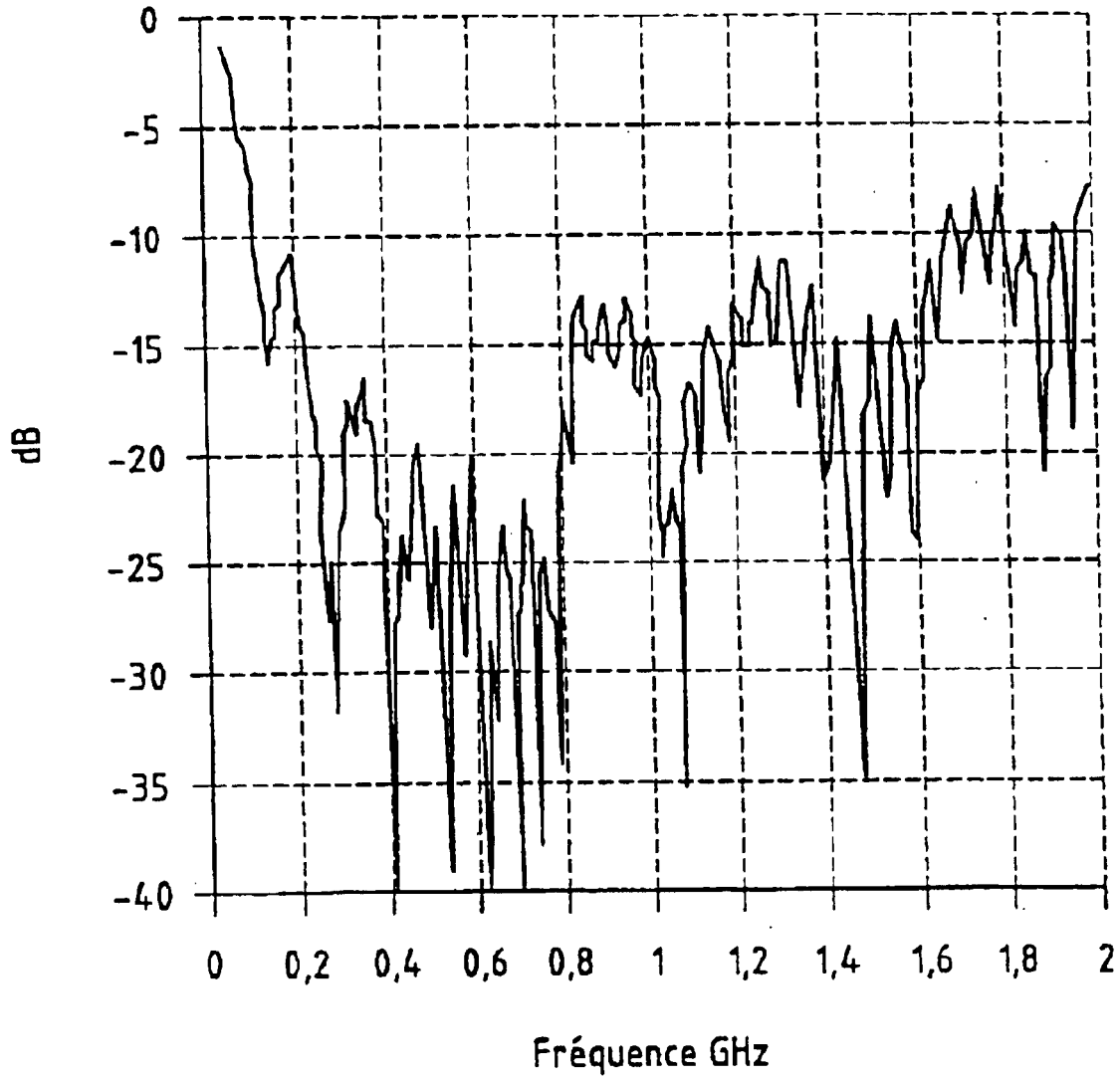
FIG. 3 is a graph representing the reflection coefficient of the antenna according to the invention.

The diagram of FIG. 3 represents the reflection coefficient of the antenna equipped with a balun of 50Ω–200Ω. A maximum level of −13 dB is obtained in the 200 MHz–1.6 GHz band.

Figure 4:
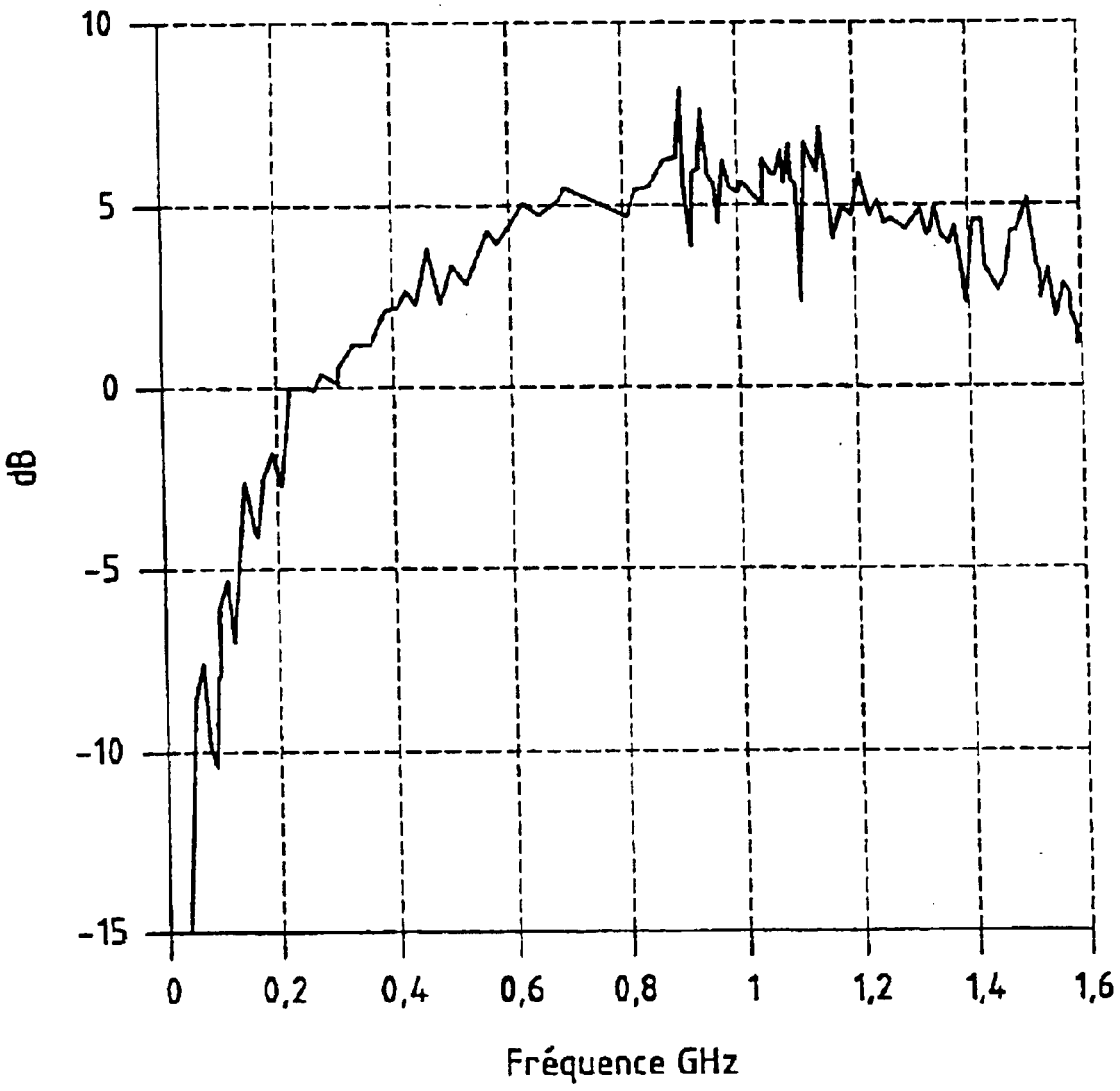
FIG. 4 is a graph representing the measurement of the gain of the antenna according to the invention.

FIG. 4 represents the gain in the axis measured in the V—V and H—H configurations.

Figure 5:
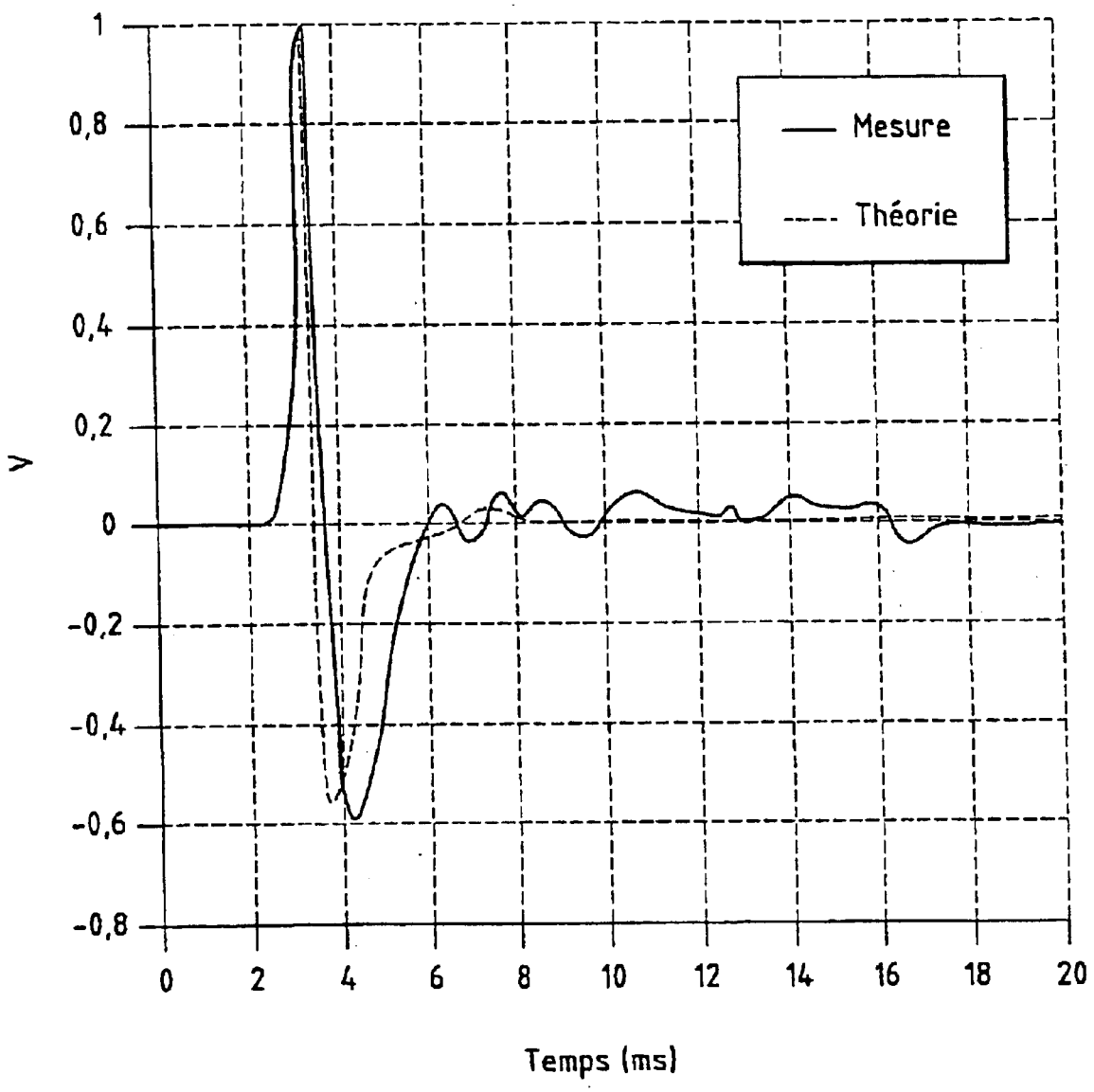
FIG. 5 is a graph representing the comparison of the theory with the measurement of the pulse measured on the axis.
Figure 6:
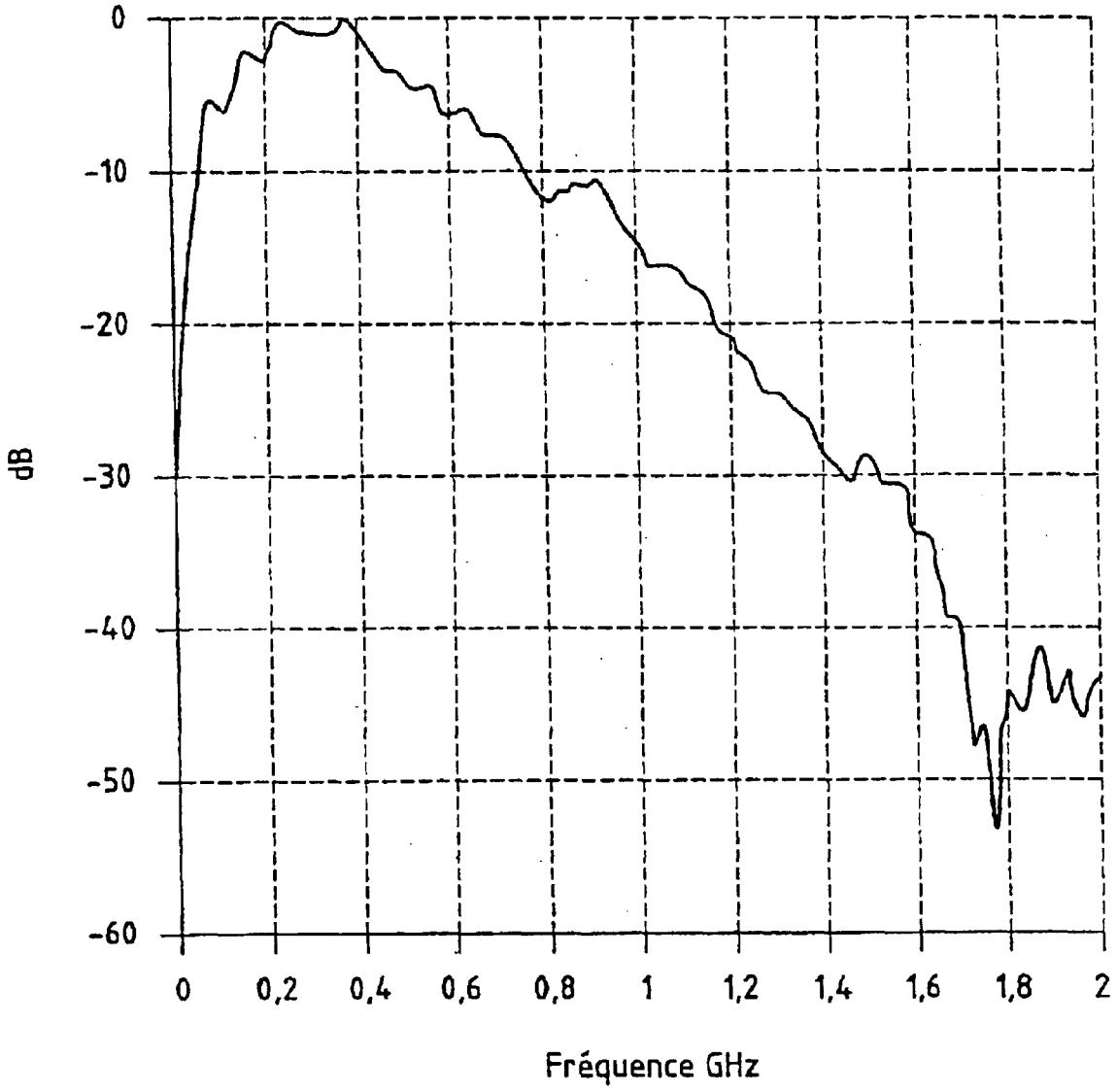
FIG. 6 is a graph of the Fourier transform of the pulse measured in the axis in VV polarization.

FIG. 5 compares the measured and theoretical signals, when two antennas are face to face at a distance of 5.80 m from each other. One antenna is emitting, energized by a HMP/F generator by the company Kentech (signal amplitude 4 kV, rise time 120 ps, signal duration 700 ps, output impedance 50Ω), and the other antenna, receiving, connected to a TDS820 oscilloscope with sequential acquisition (6 GHz passband) of the company Tecktronix. The curve shown is standardised to allow comparisons. The peak voltage level measured at the foot of the receiving antenna is about 50 volts. The dispersion remains below 1.4. The spectrum of the measured signal shown in FIG. 6 gives a passband extending from 80 MHz to 1.2 GHz at −20 dB maximum.

Figure 7:
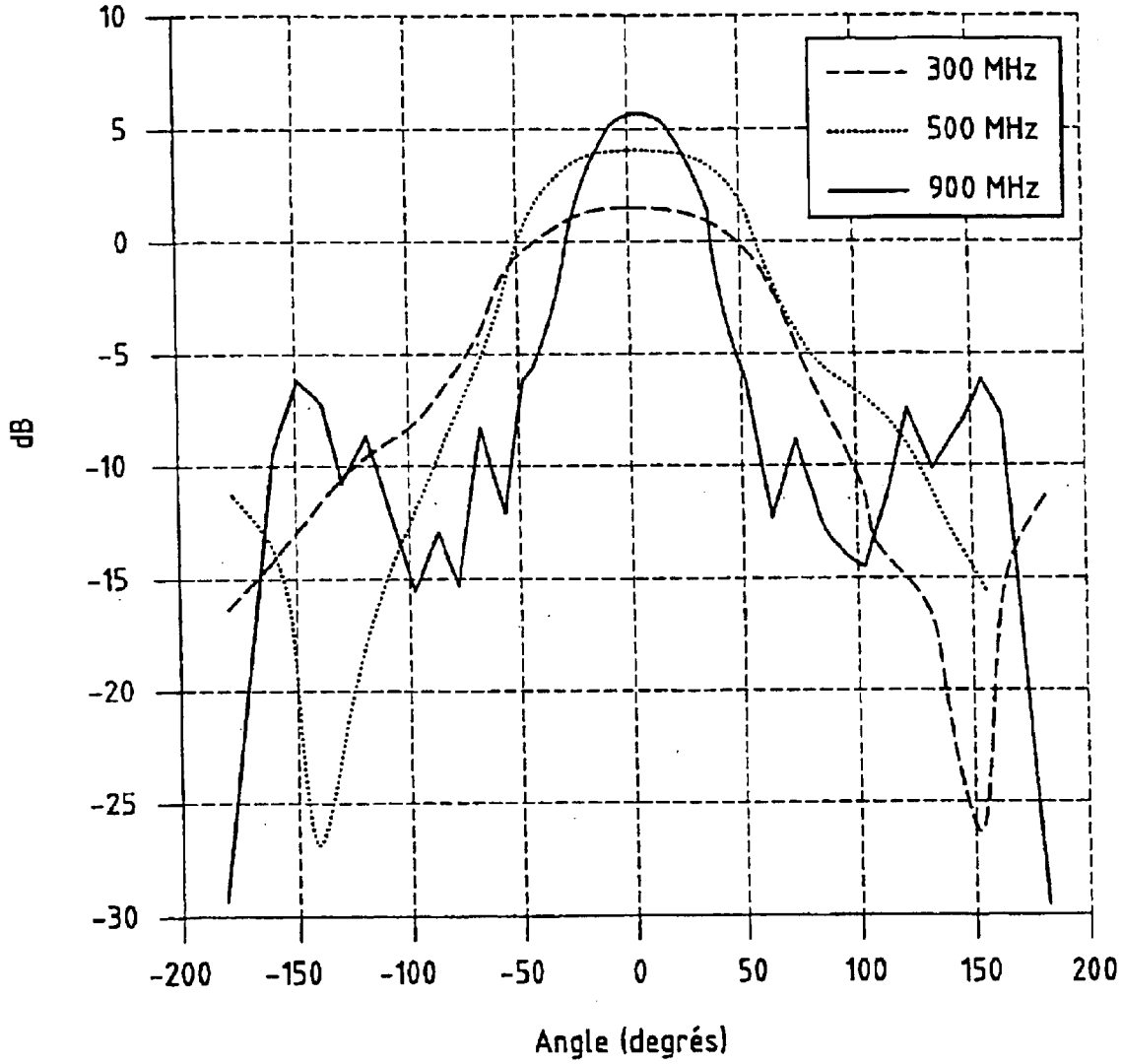
FIG. 7 is a diagram of radiation pattern in the plane H, in bearing.
Figure 8:
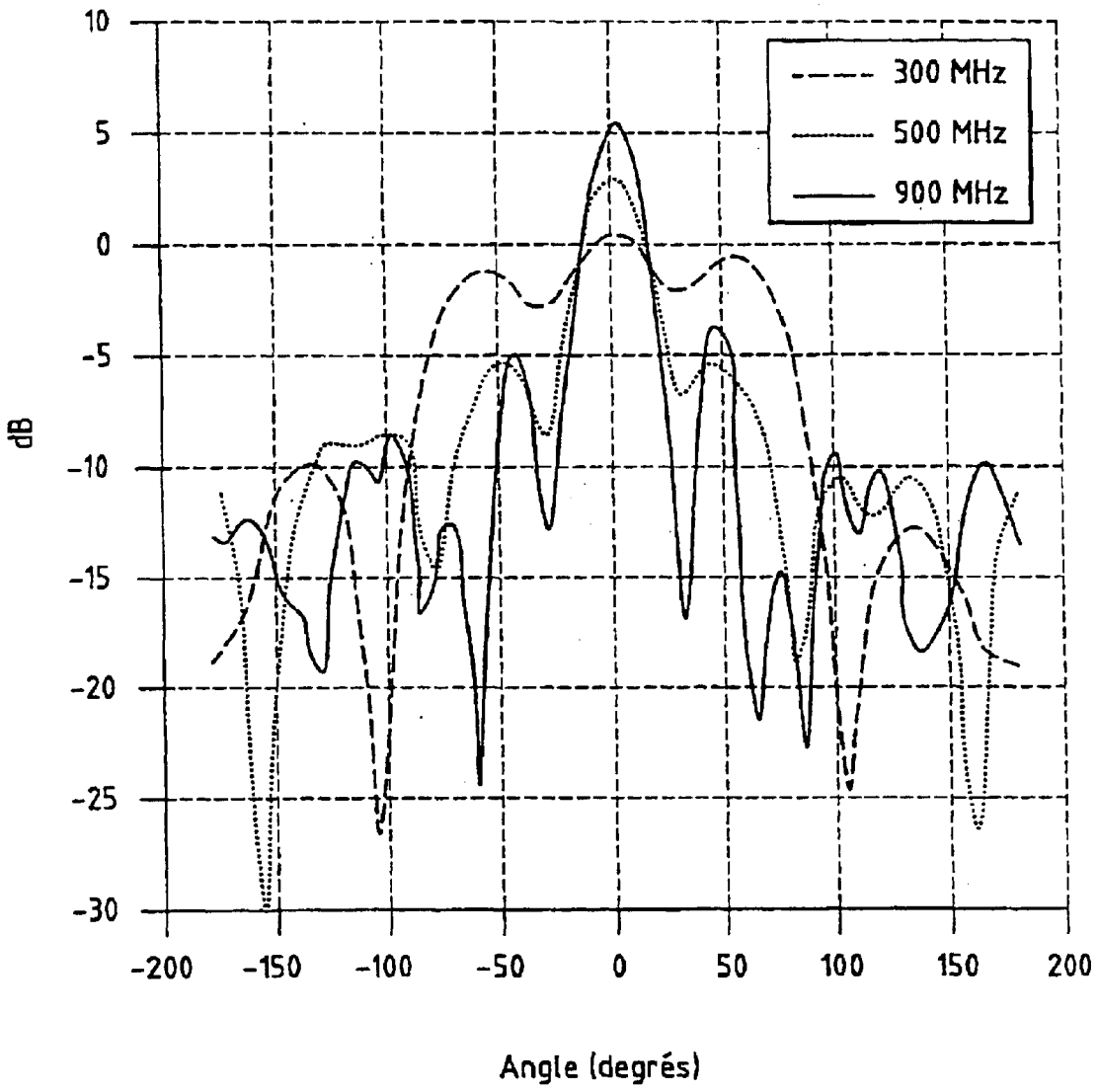
FIG. 8 is a diagram of radiation pattern in the plane E in elevation.

The radiation patterns in the plane H and in the plane E are shown in FIGS. 7 and 8. In the plane H, the main lobe has an opening half-angle of 45° at 500 MHz. In the plane E, the lobe is much narrower with an opening half-angle of 13° for the same frequency. The minor lobes in this plane are at about 8 dB (for 500 MHz) from the maximum level. The rearward radiation is at a level of −15 dB with respect to that observed in the axis.

The technical and economic advantages of the scissor-type antenna according to the invention compared with the antennas of the prior art are given in the following table.

| Antennes Large bande | Largeur de bande | Gain | Dispersion transitoire | Polarisation croisée | Réalisation pratique | Encombrement |
|---|---|---|---|---|---|---|
| Log-périodique | ↑ | ↑ | ↓ | → | ↓ | ↓ |
| Cornet à redans | ↑ | ↑ | ↓ | → | ↓ | → |
| Cornet | ↑ | ↑ | ↓ | → | ↓ | ↓ |
| Ciseaux | ↑ | → | ↑ | ↑ | ↑ | ↑ |

↑: very good
→: good
↓: poor

The scissor-type antenna, unlike conventional broad 15 band antennas, makes it possible to associate good electromagnetic performances both in harmonic mode (band width, gain) and in transient mode (dispersion).

The fields of application envisaged for the antenna according to the invention are as follows:

Electromagnetic compatibility, illumination and measuring means not bulky, especially at L. F., Measurement of Surface Equivalent Radar Low Frequency in transient mode and in harmonic mode, Mine detection (Radar imagery with synthetic opening).

What is claimed is:

1. Broad band antenna, characterised in that it comprises in a common plane two symmetrical parts (2,3) each including at least two conductor strands (4,5,7,8; 19,20,21) interconnected at both of their ends, powered at a first of their ends by a double-wire line (10; 22), each strand comprising in a second end opposed to the double-wire line a resistive load (11,12,14,15; 23,24,25,26), and in that each symmetrical part (2,3) further comprises at least one strand (6,9) not connected to the other strands (4,5,7,8) and comprising in its second end opposed to the supply line a resistive load (13, 16).

2. Antenna according to claim 1, characterised in that each symmetrical part comprises n conductor strands, interconnected or not, and each comprising a resistive load at its end, n being greater than 2.

3. Antenna according to claim 1, characterised in that the resistive loads of each strand are resistances connected in series along the length of each strand.

4. Antenna according to claim 3, characterised in that the resistances are distributed at regular intervals on each strand of the antenna.

5. Antenna according to claim 4, characterised in that the resistances Z(p) of the strands are given by the relation:

$$Z(\rho) = \frac{Z_0}{1 - \frac{\rho}{s'}},\ 0 \le \rho < s'$$

where s': portion of line with resistive load, p: position of the resistive element on the strand, $Z_0$: first load at p=0 m.

6. Antenna according to claims 1, characterised in that the resistive loads are formed by resistances of standard value associated in parallel along the end of each strand.

7. Antenna according to claim 1, characterised in that the resistances of the resistive loads are tapes of variable resistivity.

8. Antenna according to claim 1, characterised in that the strands (4,5,6,7,8,9; 18,19,20,21) are made of wire having a radius of at least 1 cm.

9. A broad band antenna, comprising:

a first part (2) and a second part (3), the first and second parts being symmetrical parts, with respect to a central axis, and located in a common plane, each of the first and second parts including plural conductor strands (4, 5, 6, 7, 8, 9) having first strand ends and second strand ends, all of the conductor strands being interconnected at the first strand ends, at least two of the conductor strands (4, 5, 7, 8) being further interconnected at the second strand ends, at least one of the conductor strands (6, 9) being free of interconnection to the other conductor strands at the second strand end;

a double-line (10) connected to the first strand ends of the first and second parts to power the first and second parts; and a separate resistive load located along an end-most length of each conductor strand and located at the second strand end of each conductor strand.

10. The antenna of claim 9, wherein each of the first and second parts consists of three conductive strands.

11. The antenna of claim 9, wherein each separate resistive load of an associated conductor strand comprises plural resistances connected in series along a length of the associated conductor strand.

12. The antenna of claim 9, wherein each separate resistive load of each associated conductor strand comprises a tape of variable resistivity.

13. The antenna of claim 9, wherein each conductor strand has a radius of at least 1 cm.

14. A broad band antenna, comprising:

a first part (2) and a second part (3), the first and second parts being symmetrical parts, with respect to a central axis, and located in a common plane, each of the first and second parts including plural conductor strands (4, 5, 6, 7, 8, 9) having first strand ends and second strand ends, all of the conductor strands being interconnected at a first node point located at the first strand ends, at least two of the conductor strands (4, 5, 7, 8) being further interconnected at a second node at an extrememost point of the second strand ends, a double-line (10) connected at the first node to the first strand ends of the first and second parts to power the first and second parts; and a separate resistive load located along a length of each conductor strand and terminating at the second strand end of each conductor strand, the resistive load forming an end-most length of each conductor strand and leaving the interconnected conductor strands free of any open ends at the second strand end.

15. The antenna of claim 14, wherein at least one of the conductor strands (6, 9) of each of the first and second parts is free of interconnection to the other conductor strands at the second strand end.

* * * * *